United States Patent [19]

van der Walt et al.

[11] Patent Number: 4,459,583

[45] Date of Patent: Jul. 10, 1984

[54] ALARM SYSTEM

[76] Inventors: Nicolaas T. van der Walt, 33 Thomas St., Meredale, Transvaal; Bernardus J. Bout, Plot No. 47, Blignautrus, Walkerville, Transvaal, both of South Africa

[21] Appl. No.: 259,164

[22] Filed: Apr. 30, 1981

Related U.S. Application Data

[63] Continuation of Ser. No. 76,455, Sep. 17, 1979, abandoned.

[30] Foreign Application Priority Data

Sep. 15, 1978 [ZA] South Africa ..... 78/5255

[51] Int. Cl.[3] ..... G08B 17/00

[52] U.S. Cl. ..... 340/589; 340/511; 340/661; 340/870.27

[58] Field of Search ..... 340/589, 588, 511, 537, 340/657, 660, 661, 650, 825.04, 825.77, 870.21, 870.27

[56] References Cited

U.S. PATENT DOCUMENTS

| | | | |
|---|---|---|---|
| 3,467,956 | 9/1969 | Moreines | 340/660 |
| 3,559,198 | 1/1971 | Moreines | 340/661 |
| 3,836,854 | 9/1974 | Wehman | 340/661 |
| 3,919,703 | 11/1975 | Stevens | 340/511 |
| 4,110,687 | 8/1978 | Sneed, Jr. | 340/661 |
| 4,152,656 | 5/1979 | Udvardi-Lakos | 340/661 |

*Primary Examiner*—Donnie L. Crosland

*Attorney, Agent, or Firm*—Oblon, Fisher, Spivak, McClelland & Maier

[57] ABSTRACT

An alarm system which includes at least one primary detecting device that provides an analog output signal. The rate of change of the analog output signal is monitored, and an alarm signal is generated when the rate of change exceeds a preset limit. The analog output signal is also compared with a first reference level signal to provide a pre-maintenance warning signal when the analog output signal reaches the first reference level.

12 Claims, 5 Drawing Figures

ALARM SYSTEM

BACKGROUND OF THE INVENTION

This is a continuation of application Ser. No. 076,455, filed Sept. 17, 1979 now abandoned.

This invention relates to an alarm system.

Alarm systems such as are employed for the purposes of fire detection or for security purposes often include a plurality of detectors which are situated in remote locations or in locations which are not easily accessible. These detectors as is the case with all others employed in a particular system must be inspected regularly to assess their working condition. The operation of the detectors is usually subject to environmental conditions, the accumulation of dirt or moisture, and the ageing of certain components. These factors produce changes in the output signal of each detector which can induce false alarms. To overcome these difficulties frequent preventative maintenance may be called for and this in turn presents obvious problems if the detectors are situated in remote locations or locations which are not easily accessible.

SUMMARY OF THE INVENTION

It is an object of the present invention to provide an alarm system which meets the primary requirement of giving a warning on the occurrence of a genuine alarm condition and which includes the facility of continuously monitoring unwanted fluctuations in the output signals of the detectors of the system.

It is also an object of the invention to provide an alarm system in which it is possible to distinguish between a genuine alarm condition and at least some false alarm conditions.

A third object of the invention is to provide an alarm system which generates a warning that preventative maintenance is called for on one or more of the detectors or other parts of the system.

The invention provides an alarm system which includes at least one detecting device which provides an analog output signal, means to monitor the rate of change of the analog output signal and provide an alarm signal when the rate of change exceeds a preset limit, and means to compare the analog output signal to a first reference level and provide a pre-maintenance warning signal when the analog output signal reaches the first reference level.

Further according to the invention the system includes means to generate a warning signal when the analog output signal reaches a preset upper or lower value which is indicative that the system is inoperative.

Further according to the invention the system includes means to compare the analog output signal to a second reference level and trigger an alarm signal when the analog output signal reaches the second reference level.

Each detecting device may be connected directly to the monitoring and comparison means by hardwire links. Alternatively if each detecting device is remote from the monitoring and comparison means, connection may be established via a telemetering link.

The invention also provides a method of processing an analog output signal of a detecting device which includes the steps of generating an alarm signal if the rate of change of the analog output signal exceeds a preset limit, and generating a pre-maintenance warning signal when the analog output signal reaches a first reference level.

The method further includes the step of generating a warning signal when the analog output signal reaches a preset upper or lower value which is indicative that the detecting device is inoperative.

BRIEF DESCRIPTION OF THE DRAWINGS

The invention is further described by way of examples with reference to the accompanying drawings in which.

DESCRIPTION OF PREFERRED EMBODIMENTS

Figure 1:
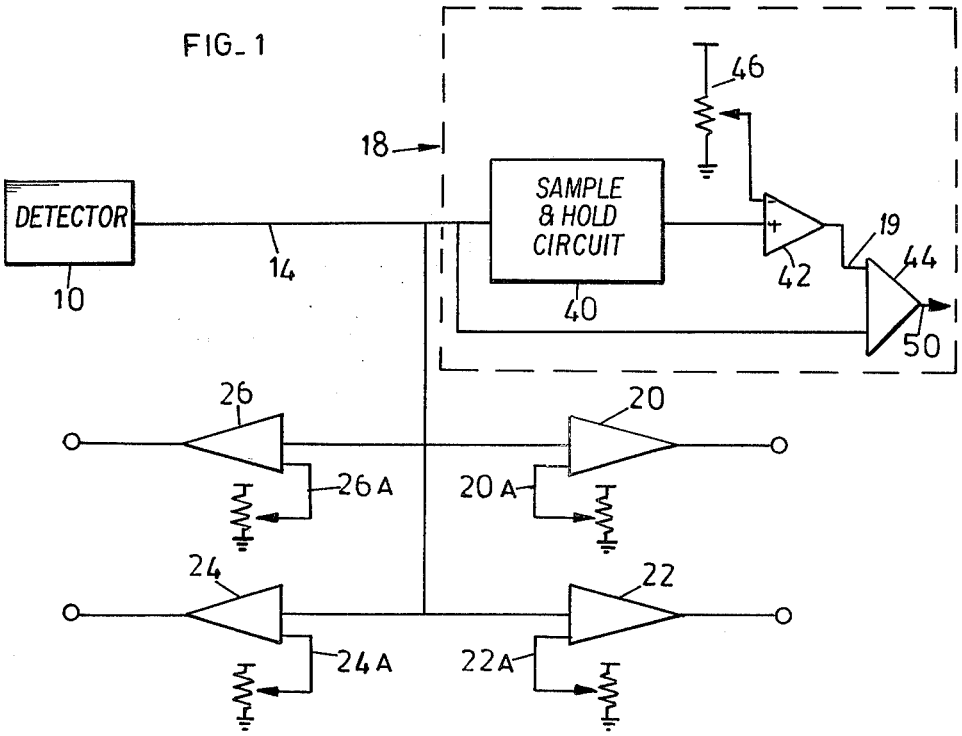
FIG. 1 illustrates an alarm system according to the invention.
Figure 3:
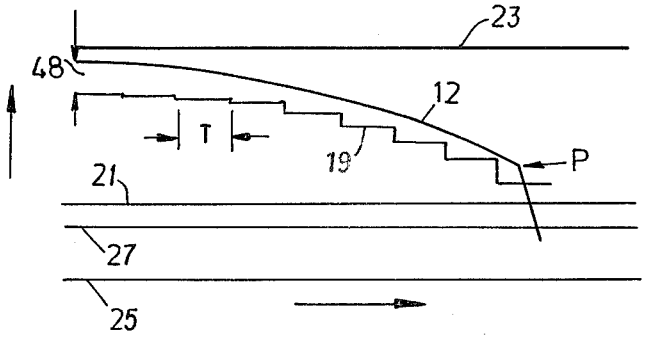
FIG. 3 illustrates in graphical form the operation of the system of FIG. 1.

FIG. 1 illustrates an alarm system which includes a primary detector 10 which produces an analog output signal 12 (See FIG. 3). The signal 12 is applied by means of cabling 14 to a rate of change detector 18 and comparators 20, 22, 24 and 26.

The primary detector 10 may be any suitable detector, for example a fire detector of the type described in the specification of South African Patent Application No. 78/6519, which produces an electrical output signal 12. The application of the invention is, of course, not limited to this particular detector.

Figure 4:
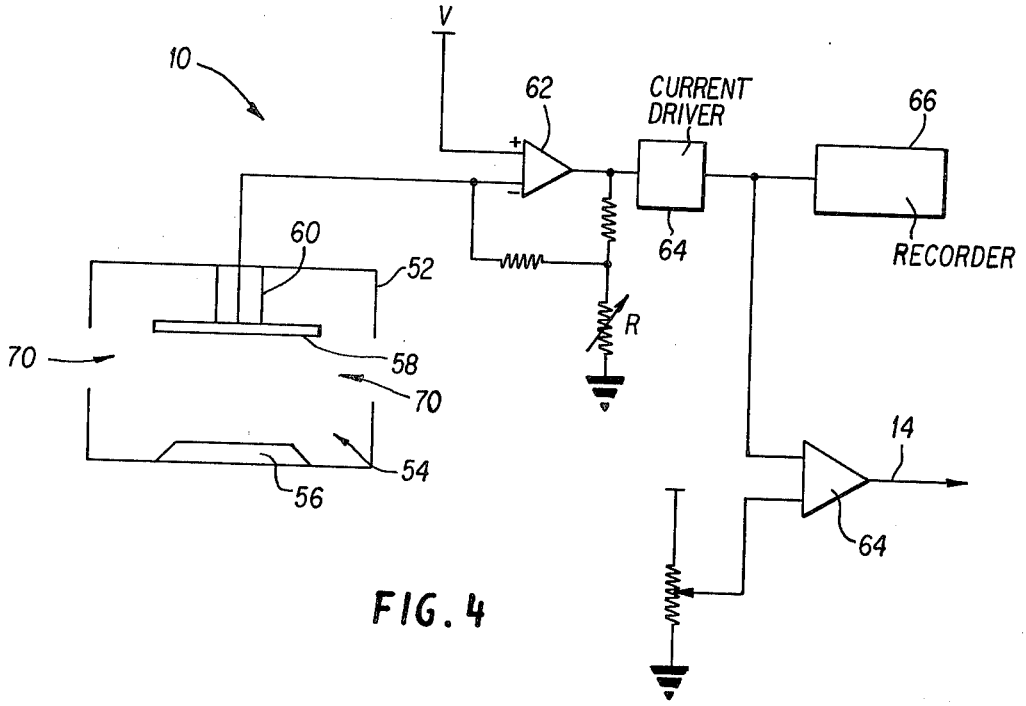
FIG. 4 schematically illustrates a detector according to the invention.

The primary detector 10 according to the invention includes a housing 52 as seen in FIG. 4 in which is formed a measuring chamber 54, an ionizing source 56 such as krypton 85 inside the chamber 54, an electrode 58 which is made of a suitable conductive material and which is supported on an insulating member 60 inside the chamber 54, a differential amplifier 62 connected to the electrode, a current driver 64 connected to the output of the amplifier 62, and a chart recorder 66 and a trigger device 68 connected in parallel to the output of the current driver 64. The housing 52 is formed with a number of apertures 70 which permit the free passage of air through the chamber 54.

The housing 52 is installed in a suitable location at an area which is to be monitored and which may be remote from a central control point at which the recorder 66 and the trigger device 68 are installed.

The chart recorder 66 records the variation with time of ionization current supplied in the chamber by the ionizing source. If combustion particles are carried into the chamber by the air the ionization current is reduced and this occurrence is recorded by the recorder. Similarly, any variation of the ionization current produced by any other cause is recorded on the recorder.

The trigger device 68 is a comparator in which amplified ionization current is compared to a reference level, and is used to initiate an alarm signal if the ionization current crosses the reference or threshold level. The threshold value can be fixed or it can be variable so that account is taken of the environmental conditions in which the detector operates. An analog output is obtained from the detector and such analog output appears on cable 14 of this invention.

The rate of change detector 18 may for example be of the type described in the specification of South African Patent Application No. 78/2493 entitled "Rate of Change Detection", and the disclosure therein is incorporated in this application.

Figure 5:
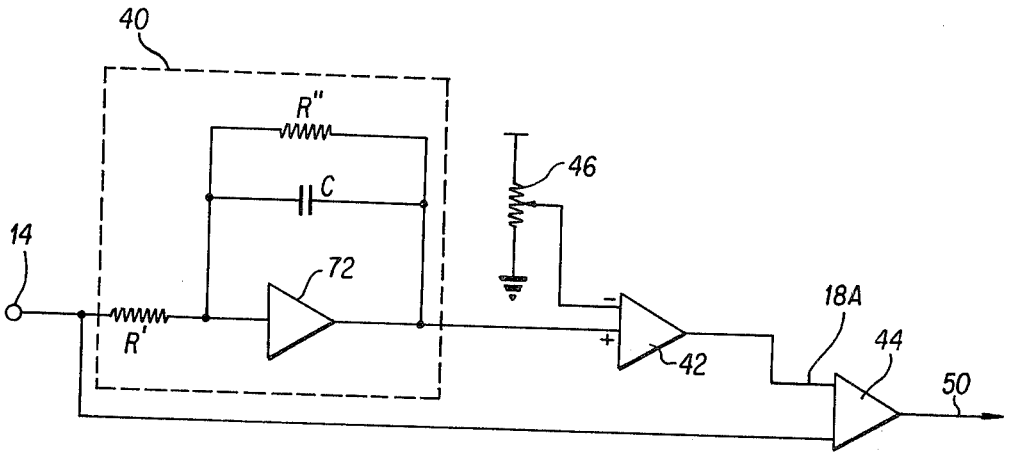
FIG. 5 schematically illustrates a rate of change detector according to the invention.

The rate of change detector 18 consists of a sample and hold circuit 40, a difference amplifier 42, and a comparator 44. The inverting input of the amplifier 42 is connected to a variable voltage source 46. The sample and hold circuit 40 as seen in FIG. 5 includes a resistor R' and an operational amplifier 72 which are connected in series and which receive the analog output signal 12 via cable 14. Another resistor R" and a capacitor C are connected in parallel and this parallel combination is connected across the input and the output of the operational amplifier. The output of the operational amplifier 72 is to the positive (+) input of the difference amplifier 42.

The circuit is designed to sample the signal 12 periodically and to generate on output 18A a reference signal 19, in step wise fashion, which has an amplitude for each period T, between sampling instants, which differs from the sampled amplitude of the signal 12, at the beginning of the period, by a gap voltage 48 (See FIG. 3).

The output voltage of the difference amplifier 42 equals the signal 12 sampled and held over the period T minus the gap voltage. This voltage is compared in the comparator 44 with the signal 12. The sampling period T of the circuit 40 and the gap voltage 48 are chosen so that the signal 19 can have a maximum rate of change, or slope, of gap voltage/T. When the rate of change of the signal 12 exceeds this maximum slope, the signals 12 and 19 cross one another and, the comparator generates an alarm signal 50 at its output.

The comparators 20 to 26 have adjustable reference levels 21 to 27 respectively, and are referred to as a pre-maintenance comparator, an upper limit comparator, a lower limit comparator and an absolute alarm device, respectively. The reference levels 21 to 27 appear on outputs 20A–26A, respectively, from comparators 20–26.

FIG. 3 is a graphical representation of the manner in which the system of FIG. 1 operates. In FIG. 3 the vertical axis represents the amplitude of the various signals encountered in the system while the horizontal axis represents time. The analogue output signal 12 of the detector 10 is shown as drifting naturally with time until at time P a genuine alarm condition occurs. The rate of change detector 18 produces the tracking signal 19 which closely follows the analog signal 12 and compensates for variations in the signal which are attributable for example to temperature variations. However, when a genuine alarm condition occurs as at time P the tracking signal is unable to follow the analog signal sufficiently rapidly and the two signals cross and the alarm warning 50 is generated.

In this example the acceptable working range of the analog signal 12 is located between the comparator levels 21 and 23 of the pre-maintenance comparator 20 and the upper limit comparator 22 respectively. Should the signal 12 reach the upper limit level 23 this will indicate that the system is inoperative. On the other hand if the signal 12 reaches the level 21 of the pre-maintenance comparator this will be indicative that maintenance is called for. The operating level of the signal 12 can then be adjusted to an acceptable amplitude.

In the lower limit comparator 24 the level 25 is continuously compared to the signal 12. Should the amplitude of the signal 12 drop to the amplitude of the level 25 a warning signal is generated indicating that the system is inoperative. Warning signals could also be generated by the comparators 20 and 26 but the signal from the comparator 24 would enable one to distinguish a failure of the system from a maintenance or alarm condition.

The absolute alarm comparator 26 produces a level 27 which is also compared to the analog signal 12. An alarm signal will be generated by the comparator 26 if for example the analog signal 12 falls below the pre-maintenance level 21 at a rate which is not sufficiently high to cause it to cross the reference signal 19 of the rate of change detector 18.

The alarm system of FIG. 1 is thus able to achieve its primary function of providing an alarm on the occurrence of a genuine alarm condition. In addition a backup is provided by the alarm comparator 26. The comparators 20, 22 and 24 are used to analyse the analog signal 12 and enable one to discriminate between false and genuine alarm conditions.

Figure 2:
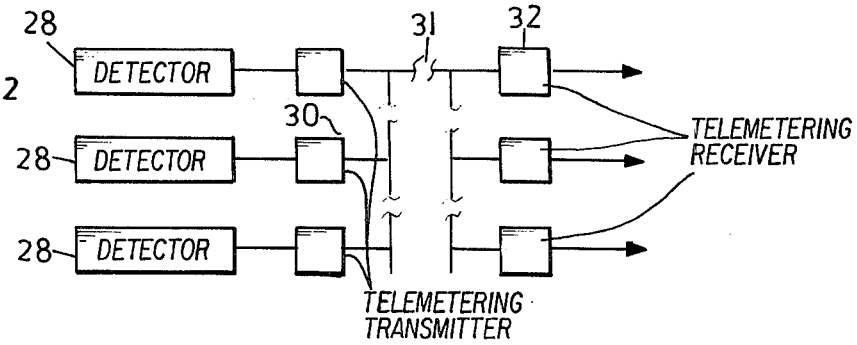
FIG. 2 schematically illustrates one way in which the system of FIG. 1 can be modified.

The modification of the alarm system shown in FIG. 2 enables the primary detectors 12 to be located at positions remote from the devices 18 to 26. This drawing illustrates a number of primary detectors 28 whose output signals are fed to telemetering transmitters 30 which are capable of transmitting analog information. The outputs of the transmitters are fed via a suitable conventional telemetering link 31 to corresponding telemetering receivers 32. The output signals of the receivers 32 are analog signals which correspond and are proportional to the analog output signals of the various detectors 28. These output signals are applied at a control point to the various devices 18 to 26 which monitor the analog signals in the manner already described in connection with FIG. 1.

The alarm system of the invention has particular relevance to fire detection systems and security systems but clearly the principles of the invention are applicable to any other system in which use is made of monitoring, warning or detecting devices.

We claim:

1. An alarm system which includes at least one detecting device which provides an analog output signal defining an instantaneous amplitude, means for monitoring a rate of change of the analog output signal and for providing an alarm signal when the rate of change exceeds a preset limit, said monitoring means comprising means for generating a periodically step-wise adjusted reference signal having an amplitude periodically adjusted to differ from the instantaneous amplitude of the analog output signal by a predetermined amount and means for comparing the analog output signal with the periodically step-wise adjusted reference signal, and means for comparing the analog output signal to a first reference level and providing a premaintenance warning signal when the analog output signal reaches the first reference level.

2. An alarm system according to claim 1 which includes means to generate a warning signal when the analog output signal reaches a preset upper or lower valve which is indicative that the system is inoperative.

3. An alarm system according to claim 1 which includes means to compare the analog output signal to a second reference level and trigger an alarm signal when the analog output signal reaches the second reference level.

4. An alarm system according to claim 1 in which each detecting device is connected to the monitoring and comparison means by hardwire links.

5. An alarm system according to claim 1 in which each detecting device is remote from the monitoring and comparison means and is connected thereto via a telemetering link.

6. A method of processing an analog output signal of a detecting device, said analog output signal defining an instantaneous amplitude, which includes the steps of generating an alarm signal if a rate of change of the amplitude of the analog output signal exceeds a preset limit by generating a periodically step-wise adjusted reference signal having an amplitude which is periodically adjusted to differ from the instantaneous amplitude of the analog output signal by a predetermined amount and comparing the instantaneous amplitude analog output signal with the amplitude of the periodically step-wise adjusted reference signal and producing an alarm signal when said instantaneous amplitude of the analog output signal is equal to the amplitude of the periodically step-wise adjusted reference signal, and generating a pre-maintenance warning signal when the analog output signal reaches a first reference level.

7. A method according to claim 6 which further includes the step of generating a warning signal when the analog output signal reaches a preset upper or lower value which is indicative that the detecting device is inoperative.

8. An alarm system comprising:

at least one detecting device which provides an analog output signal defining an instantaneous amplitude;

means for monitoring a rate of change of the analog output signal and providing an alarm signal when the rate of change exceeds a predetermined rate, comprising, means for generating a periodically step-wise adjusted reference signal having an amplitude periodically adjusted to differ from the instantaneous amplitude of said analog output signal at each adjustment by a predetermined amount, and means for comparing the analog output signal with said periodically step-wise adjusted reference signal to provide an alarm signal when said analog output signal and said step-wise adjusted reference signal are equal in amplitude; and means for comparing the analog output signal with preset upper and lower values to provide a signal indicative that the system is inoperative when the analog output signal reaches either the upper and lower value.

9. An alarm system according to claim 8, comprising:

means for comparing the analog output signal with a substantially constant reference signal which is reached by the analog output signal before one of the upper and lower preset values is reached and for indicating an alarm condition and triggering an alarm signal when the analog output signal reaches the constant reference level.

10. An alarm system according to claim 8 in which each detecting device is remote from the monitoring means and is connected to the monitoring means by hardwire links.

11. An alarm system according to claim 8 in which each detecting device is remote from the monitoring and is coupled thereto via a telemetering link.

12. A method of processing an analog output signal, defining an instantaneous amplitude, of a detecting device, including the steps of generating an alarm signal if the rate of change of the analog output signal exceeds a predetermined limit, wherein the rate of change is determined by comparing the instantaneous amplitude of the analog output signal with a periodically step-wise adjusted reference signal having an amplitude periodically adjusted to be different from the instantaneous amplitude of said analog output signal by a predetermined amount, and an alarm signal is generated when the analog output signal reaches either an upper or lower preset level indicative that the detecting device is inoperative.

* * * * *